United States Patent [19]

Cathriner

[11] 4,006,630

[45] Feb. 8, 1977

[54] WELL TESTING APPARATUS

[75] Inventor: Richard L. Cathriner, Plano, Tex.

[73] Assignee: Atlantic Richfield Company, Los Angeles, Calif.

[22] Filed: May 26, 1976

[21] Appl. No.: 690,107

[52] U.S. Cl. ..... 73/155

[51] Int. Cl.[2] ..... E21B 47/06

[58] Field of Search ..... 73/151, 152, 155; 166/100, 115, 116, 162

[56] References Cited

UNITED STATES PATENTS 2,970,470 2/1961 Kenneday ..... 73/151

3,323,361 6/1967 Lebourg ..... 73/155

*Primary Examiner*—Jerry W. Myracle

*Attorney, Agent, or Firm*—Roderick W. MacDonald

[57] ABSTRACT

Downhole well testing apparatus employing a mandrel which carries a testing means, the testing means being connected to an opening in the mandrel, and packing means for isolating the opening in the mandrel so that at least a portion of the formation to be tested is connected only to said testing means.

4 Claims, 1 Drawing Figure

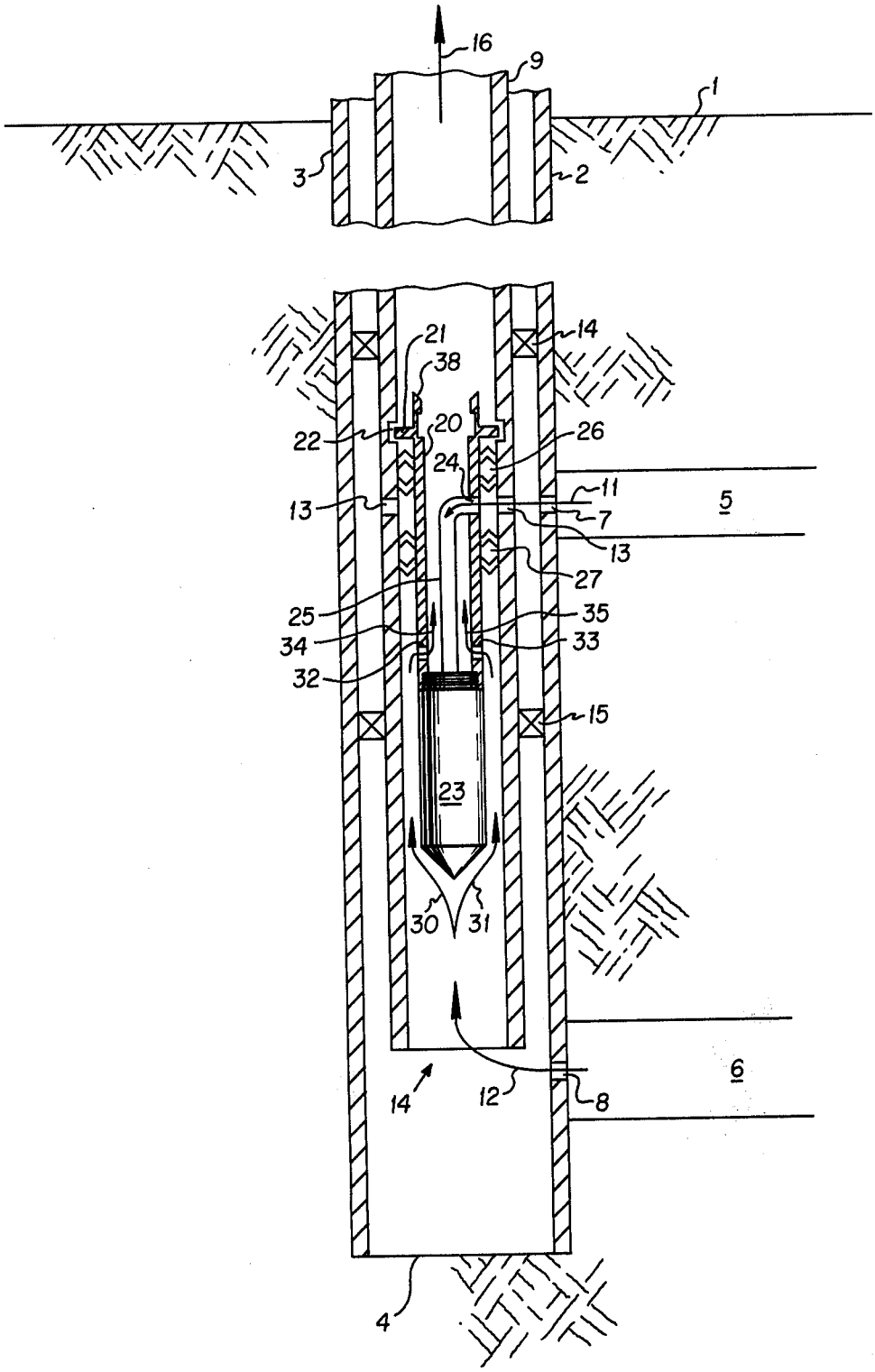
16
9
1
3
2
21
38
14
20
22
26
24
11
5
13
7
13
27
25
35
34
33
32
15
23
30
31
6
14
12
8
4

WELL TESTING APPARATUS

BACKGROUND OF THE INVENTION

Heretofore in wells where two or more formations are producing into a single interior pipe and the fluids from all the formations are co-mingled in the pipe for production to the earth's surface, it has been difficult to test, e.g. pressure test, a single formation. This is so because it is difficult to isolate one formation so that the test results are reliably attributable to that formation and no other formation in the well and to do so without interrupting production from the other formations.

SUMMARY OF THE INVENTION

According to this invention there is provided downhole well testing apparatus which can be employed in a well which is multiply completed, i.e., a plurality of formations producing into a single well pipe. The apparatus employs a mandrel means adapted to pass into the interior of the well to the situs of testing. The mandrel carries at least one testing means and the testing means is operatively connected to at least one aperture which communicates with the outside of the mandrel. Packing means are employed outside the mandrel for isolating the at least one aperture in an annulus outside the mandrel so that one formation can be isolated from the other formations and put in communication with the testing device. By-pass means are carried by the mandrel to allow fluid from other formations not undergoing testing to pass by the mandrel after the packing means is set and at least a portion of the formation under test is in communication only with the testing device carried by the mandrel.

This invention is useful for a number of situations that occur in wells of any type as will be obvious to one skilled in the art. For example, this invention can be used for a packer leakage test; for pressure testing (e.g., pressure fall-off) multiple zone, single string injection wells; for pressure testing (e.g., pressure build-up) multiple completion, single string producing wells, and so on. It will also be apparent to those skilled in the art that this invention can be employed in a submersible pumping installation. For example, in such an installation bottom hole pressure data can be obtained in wells with small casing without removing either the pump or the tubing and without running a signal wire or instrumentation tubing from the earth's surface to the bottom hole pump. It will also be obvious to one skilled in the art that the apparatus of this invention is not limited to oil and gas wells but can be applied to numerous situations in any type of well which produces a fluid including, but not limited to hydrocarbonaceous fluids.

Accordingly, it is an object of this invention to provide a new and improved downhole well testing apparatus. It is another object to provide new and improved apparatus for testing a single formation in a well which contains a plurality of formations and to do so without interrupting the production from the non-tested formations. Other aspects, objects and advantages of this invention will be apparent to those skilled in the art from this disclosure and the appended claims.

DETAILED DESCRIPTION OF THE INVENTION

The drawing shows a cross-section of a well in the earth employing the apparatus of this invention.

More specifically, the drawing shows the earth's surface 1 having a wellbore 2 drilled thereinto, wellbore 2 being lined by conventional metal casing 3 down to the bottom 4 of the wellbore. Wellbore 2 is multiply completed in that it is in fluid communication with a plurality of producing zones, two producing zones 5 and 6 in the drawing. Fluid communication is achieved by way of openings 7 and 8 through casing 3. Thus, fluids produced from both formations 5 and 6 pass into the interior of the wellbore. Tubing 9 is provided in the interior of the wellbore to receive the produced fluids from both formations 5 and 6 as shown by arrows 11 and 12. The fluids from formation 5 pass through one or more openings 13 in tubing 9 while the fluids from formation 6 pass through open bottom 14 of tubing 9. Thus, all produced fluids are co-mingled with one another in the interior of tubing 9. Pack-offs 14 and 15 are provided above and below, respectively, openings 13 in the annulus between the outer surface of tubing 9 and inner surface of casing 3. This assures that the fluids produced from formation 5 pass through opening 13 into the interior of tubing 5 for production to the earth's surface as shown by arrow 16.

Although this invention can be employed in a well by using means other than conventional wire-line equipment, for sake of clarity the invention will hereinafter be described in detail in a manner adapted to wire-line equipment. This invention is not to be construed to be limited to wire-line use, however.

In the drawing, there is shown in the interior of tubing 9 in the vicinity of formation 5, which is the formation to be tested, an open mandrel 20 which carries at its upper end laterally extending locking dogs 21 which are adapted to mate with a notch or groove 22 carried on the interior of tubing 9. Mandrel 20 can be run down the interior of tubing 9 using a conventional wire-line setting tool and when the mandrel reaches the vicinity of formation 5 can be locked in place by setting locking dogs 21 into groove 22 after which the setting tool can be removed and the mandrel will remain in place in tubing 9. The lower end of mandrel 20 has threadably engaged thereto a testing means 23 which can carry one or more testing devices (not shown) in the fluid sealed interior of device 23.

Mandrel 20 has at least one aperture 24 extending through the side wall of the mandrel to provide fluid communication between the interior and exterior of mandrel 20. In the interior of mandrel 20 conduit means 25 is provided to give closed communication between aperture 24 and the interior of testing means 23. Packing means 26 is carried on the outer surface of mandrel 20 above aperture 24 so that it can seal off the annulus between the outer surface of mandrel 20 and the inner surface of tubing 9. Similarly packing means 27 is disposed below aperture 24 so that when both packing means 26 and 27 are set, a closed path of flow for fluid from formation 5 is provided, this flow path being through openings 7 and 13, aperture 24, and conduit 25 to the interior of testing means 23. Accordingly, formation 5 is isolated from the co-mingled produced fluids in the interior of tubing 9 and testing means 23 is in communication only with formation 5 so that reliable testing of only formation 5 can be carried out.

In the meantime, fluids produced from formation 6 pass upwardly into the interior of tubing 9, split around testing means 23 as shown by arrows 30 and 31, and by-pass packing means 26 and 27 by flowing to the interior of mandrel 20 through openings 32 and 33 as shown by arrows 34 and 35. This way produced fluids from formation 6 can continue to be produced to the earth's surface notwithstanding the isolation and testing all or part of formation 5.

When the testing is completed, a conventional wire-line retrieving mandrel can be run into the interior of tubing 9 until it engages the upper slanted surface 38 of mandrel 20 whereby locking dogs 21 are removed from groove 22. Mandrel 20, with its associated testing means 23, can then be removed from the well for access to the data obtained and stored in testing means 23.

Although this invention has been described for the testing of a single formation 5, grooves similar to groove 22 can be provided along the length of tubing 9 for as many formations as are producing into the well so that each formation can be tested using the apparatus described hereinabove with respect to formation 5 of the drawing.

Any conventional downhole testing device can be employed in testing means 23, for example, a pressure recorder which records pressure versus time and which is conventionally referred to in the art as an Amerada Bomb. Other known testing devices can be employed alone or in combination in the apparatus of this invention.

Reasonable variations and modifications are possible within the scope of this disclosure without departing from the spirit and scope of this invention.

The embodiments of the invention in which an exclusive property or privilege is claimed are defined as follows:

1. Downhole well testing apparatus comprising mandrel means adapted to pass through said well to the situs of testing, said mandrel having at least one aperture communicating with the outside thereof, said mandrel carrying testing means, conduit means operatively connecting said at least one aperture to said testing means, packing means carried by said mandrel for isolating said at least one aperture in an annulus between said mandrel and a surface outside said mandrel, and by-pass means carried by said mandrel to allow fluid to pass by said mandrel after said packing means is set.

2. Downhole well testing apparatus according to claim 1 wherein said mandrel is adapted to be run, set, and retrieved by use of wire-line equipment.

3. Downhole well testing apparatus according to claim 1 wherein said mandrel is a cylindrical body carrying locking dogs at the upper end thereof and said testing means is spaced below said locking dogs, said at least one aperture extends through the wall of said cylindrical body intermediate said locking dogs and said testing means, said packing means is composed of at least one annular packing device disposed on the outer surface of said cylindrical body above said at least one aperture, and at least one annular packing device disposed on the outer surface of said cylindrical body below said at least one aperture, and said by-pass means is composed of at least one opening in said cylindrical body which allows fluid to pass from outside said cylindrical body below the lowermost of said packing means into the interior of said cylindrical body and to exit from the top of said cylindrical body thereby by-passing said packing means by traveling through the interior of said cylindrical body.

4. Downhole well testing apparatus according to claim 3 wherein said testing means is a pressure recorder carried in a sealed container so that pressurized fluid can reach said recorder only by way of said at least one aperture and said conduit means.

* * * * *